US006435912B1

(12) United States Patent
Zhu et al.

(10) Patent No.: US 6,435,912 B1
(45) Date of Patent: Aug. 20, 2002

(54) ELECTRICAL CONNECTOR WITH IMPROVED TERMINAL ARRANGEMENT AND STRUCTURE

(75) Inventors: ZiQiang Zhu; ZhongHua Yao; Yong Zhang, all of Kunsan (CN)

(73) Assignee: Hon Hai Precision Ind. Co., Ltd., Taipei Hisen (TW)

( * ) Notice: Subject to any disclaimer, the term of this patent is extended or adjusted under 35 U.S.C. 154(b) by 0 days.

(21) Appl. No.: 09/745,126

(22) Filed: Dec. 20, 2000

(30) Foreign Application Priority Data

Oct. 20, 2000 (TW) ..... 089218236 U

(51) Int. Cl.[7] ..... H01R 13/648
(52) U.S. Cl. ..... 439/607; 439/101
(58) Field of Search ..... 439/607–609, 439/660, 78, 83, 101, 92, 108

(56) References Cited

U.S. PATENT DOCUMENTS 6,007,382 A * 12/1999 Wu ..... 439/607
6,099,335 A * 8/2000 Chang ..... 439/607
6,146,157 A * 11/2000 Lenoir et al. ..... 439/101
6,183,300 B1 * 2/2001 Belopolsky et al. ..... 439/607
6,257,930 B1 * 7/2001 Yu ..... 439/607
6,270,379 B1 * 8/2001 Huang et al. ..... 439/607

* cited by examiner

*Primary Examiner*—Hien Vu
(74) *Attorney, Agent, or Firm*—Wei Te Chung

(57) ABSTRACT

A universal serial bus (USB) connector (100) includes a row of terminals (20) fixedly received in receiving passageways (13) defined in a face of a mating tongue (12) of an insulative housing (10) of the connector. The terminals include a middle grounding terminal (21) which is longer than two signal terminals (23) beside the grounding terminal. The mating tongue forms protrusions (141) projecting rearwardly into recesses (204) defined in a front edge of each terminal thereby securing the terminals to the mating tongue.

2 Claims, 3 Drawing Sheets

ELECTRICAL CONNECTOR WITH IMPROVED TERMINAL ARRANGEMENT AND STRUCTURE

BACKGROUND OF THE INVENTION

1. Field Of the Invention

The present invention relates to an electrical connector, and particularly to a universal serial bus (USB) connector having an improved arrangement and structure regarding terminals thereof.

2. Description of the Prior Art

A USB connector is used for connecting a main trace and a peripheral device. U.S. Pat. No. 6,007,382 disclosed a USB connector having four conductive terminals arranged in a row. The two terminals are used for transmitting signals and the two outer terminals are used for transmitting power. The USB connector is used in a high speed transmission environment. This causes a problem of cross talk between the signal terminals, which results in a low signal/noise ratio. Moreover, as the terminals have a free end which is not secured to a housing of the connector, the terminals may be warped or damaged when a mating connector is not very carefully inserted into the connector.

Hence, an improved universal serial bus connector is required to overcome the disadvantages of the prior art.

SUMMARY OF THE INVENTION

A first object of the present invention is to provide an improved universal serial bus connector having an improved terminal arrangement for reducing cross talk between signal terminals thereby improving transmitting quality of terminals.

A second object of the present invention is to provide an improved universal serial bus connector having terminals with free ends which can be securely fixed to a housing of the connector thereby preventing the terminals from being warped or damaged during a mating of the connector with a complementary connector.

To fulfill the above mentioned objectives, a universal serial bus connector according to the present invention comprises a shield, an insulative housing having a plurality of receiving passageways therein and a plurality of terminals correspondingly received in the receiving passageways. The terminals have a grounding terminal between two adjacent signal terminals for reducing cross talk between the signal terminals. Additionally, a recess defined in a front edge of a free end of each terminal correspondingly engages with a protrusion projecting into a corresponding receiving passageway of a mating tongue of the housing thereby preventing the terminal from being warped or damaged when the terminal mates a corresponding terminal of a complementary connector.

Other objects, advantages and novel features of the invention will become more apparent from the following detailed description of the present embodiment when taken in conjunction with the accompanying drawing.

DESCRIPTION OF THE PREFERRED EMBODIMENT

Figure 1:
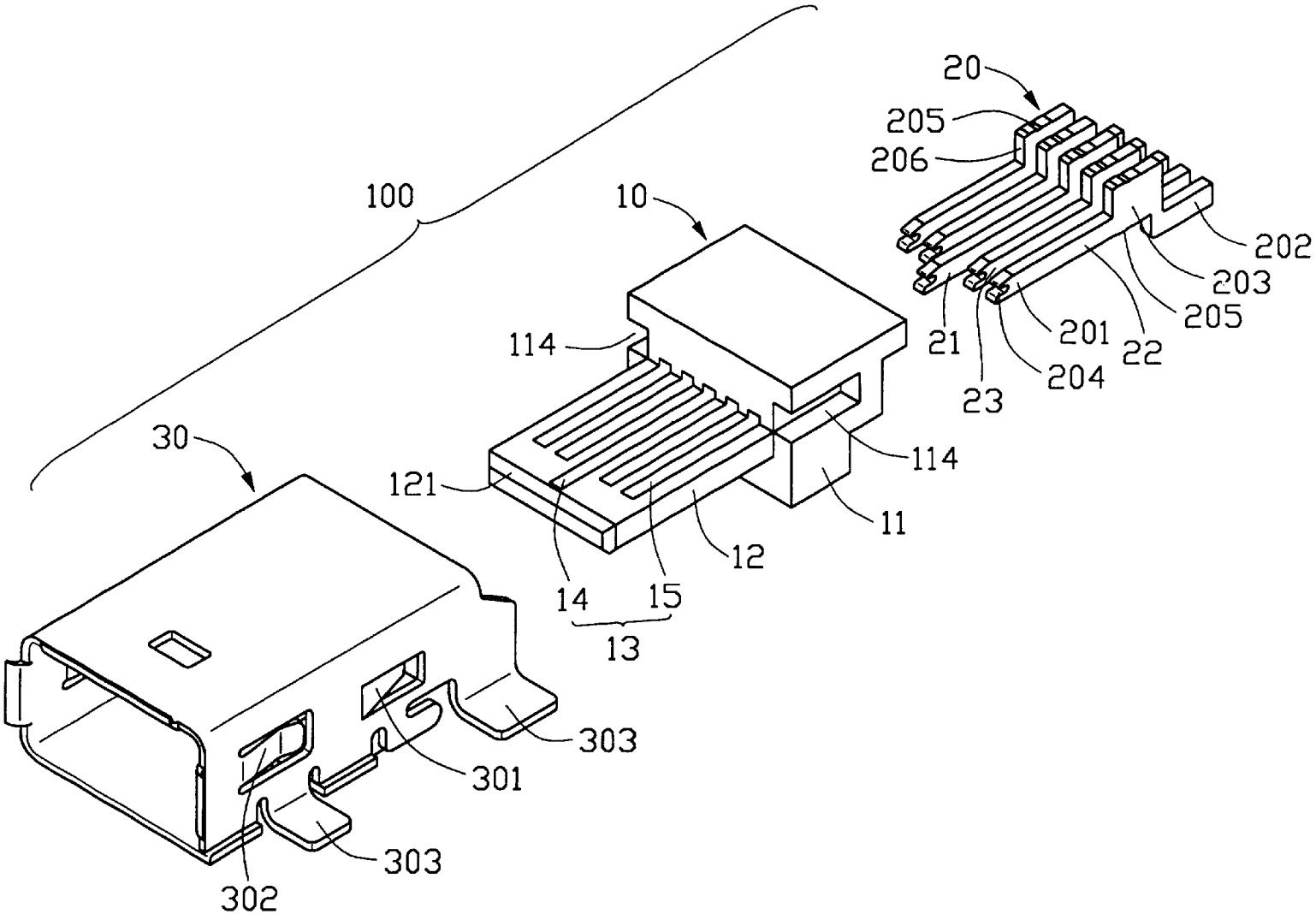
FIG. 1 is an exploded perspective view of a universal serial bus connector in accordance with the present invention.
Figure 2:
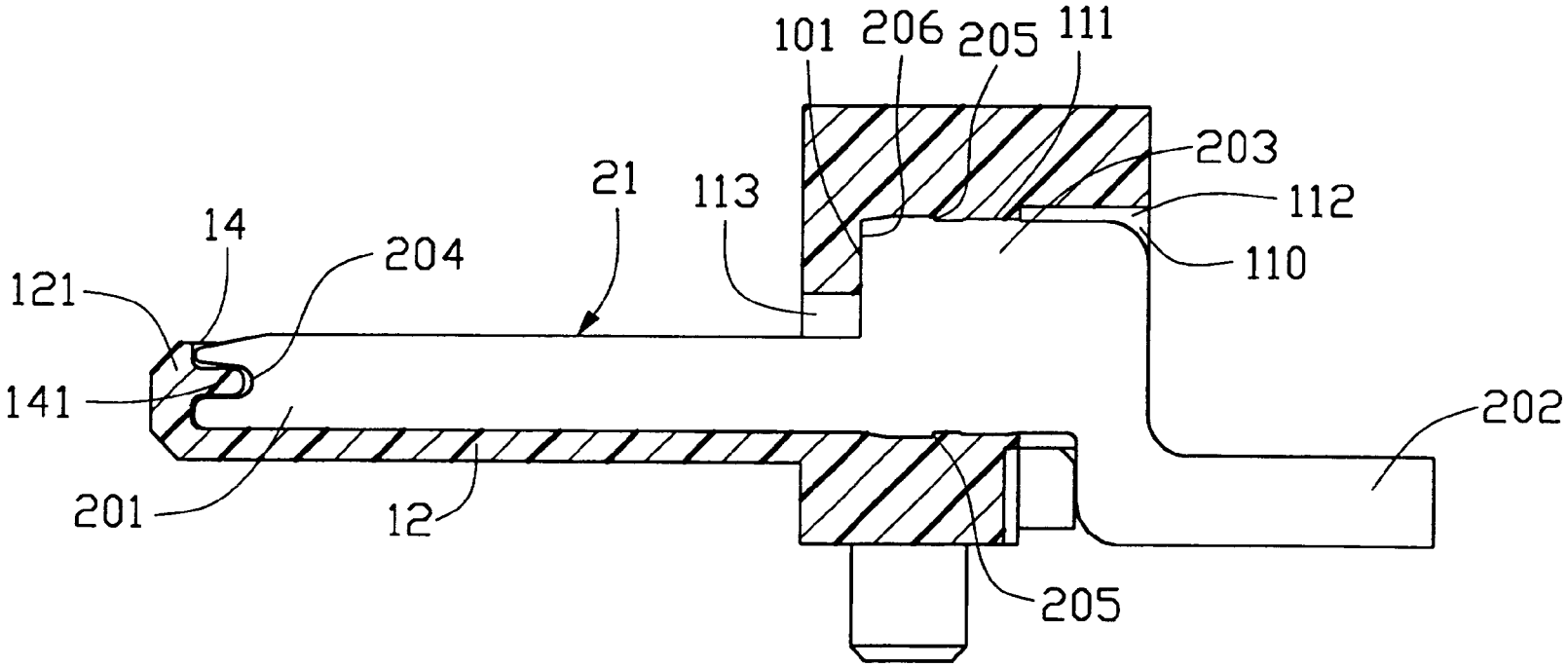
FIG. 2 is a cross sectional view of the universal serial bus connector of FIG. 1 in an assembled condition wherein a shield thereof is removed.

Referring to FIG. 1 and FIG. 2, a universal serial bus connector 100 in accordance with the present invention comprises an insulative housing 10, a plurality of terminals 20 and a shield 30.

The insulative housing 10 includes a base 11 and a mating tongue 12 projecting forwardly from a front face of the base 11. Five receiving passageways 13 are defined in an upper face of the mating tongue 12 for receiving the terminals 20 therein. One of the receiving passageways 13 located in a middle of the upper face of the mating tongue 12 is named as a middle receiving passageway 14 which is a little longer than side receiving passageways 15. The mating tongue 12 has a front end 121 which forms a plurality of protrusions 141 extending rearwards into the receiving passageways 13, respectively. The base 11 of the insulative housing 10 defines a plurality of through holes 110 horizontally extending throughout the base 11 and correspondingly communicating with the receiving passageways 13 in the mating tongue 12. Each hole 110 has a large rear section 112 also opening to a bottom of the housing 10, a middle section 111 and a small front section 113. The housing 10 forms a step 101 between the front and middle sections 113, 111 of the hole 110.

Five terminals 20 include two outer power terminals 22, a grounding terminal 21 and two signal terminals 23 between the power and grounding terminals 22, 21, respectively. Except that the grounding terminal 21 has a longer contacting portion 201, these terminals 20 have the same configuration. Each terminal 20 has a rectangular retaining portion 203 with engaging barbs 205 formed on its top and bottom edges, respectively, the elongated contacting portion 201 horizontally extending from a lower part of a front edge of the retaining portion 203, and a soldering portion 202 horizontally extending from a rear part of the bottom edge of the retaining 201 of each terminal 20. The soldering portion 202 is used to be soldered to a printed circuit board (not shown) by surface mounting technology. An abutment 206 is defined on the front edge of the retaining portion 203 above the contacting portion 201.

The terminals 20 are assembled to the housing 10 by inserting the terminals into the holes 110 from a rear of the housing 10 to reach an assembled position. In the assembled position, the abutment 206 abuts against the corresponding step 101 of the housing 10 in the corresponding hole 110. The contacting portion 201 is received in a corresponding receiving passageway 13 with the protrusion 141 of the mating tongue 12 fitting into the recess 204 defined in the front edge of the contacting portion 201. The contacting portion 201 of the grounding terminal 21 is received in the longer middle receiving passageway 14 and the contacting portions 201 of the other terminals are received in the shorten receiving passageways 15. The barbs 205 bite into the housing 10 which defines the middle section 111 of the hole 110 and the soldering portion 202 extends out of the base 11 through a lower part of the large section 112 of the hole 110. Finally, the shield 30 is assembled to the housing 10 to enclose the housing 10 and the terminals 20.

Figure 3:
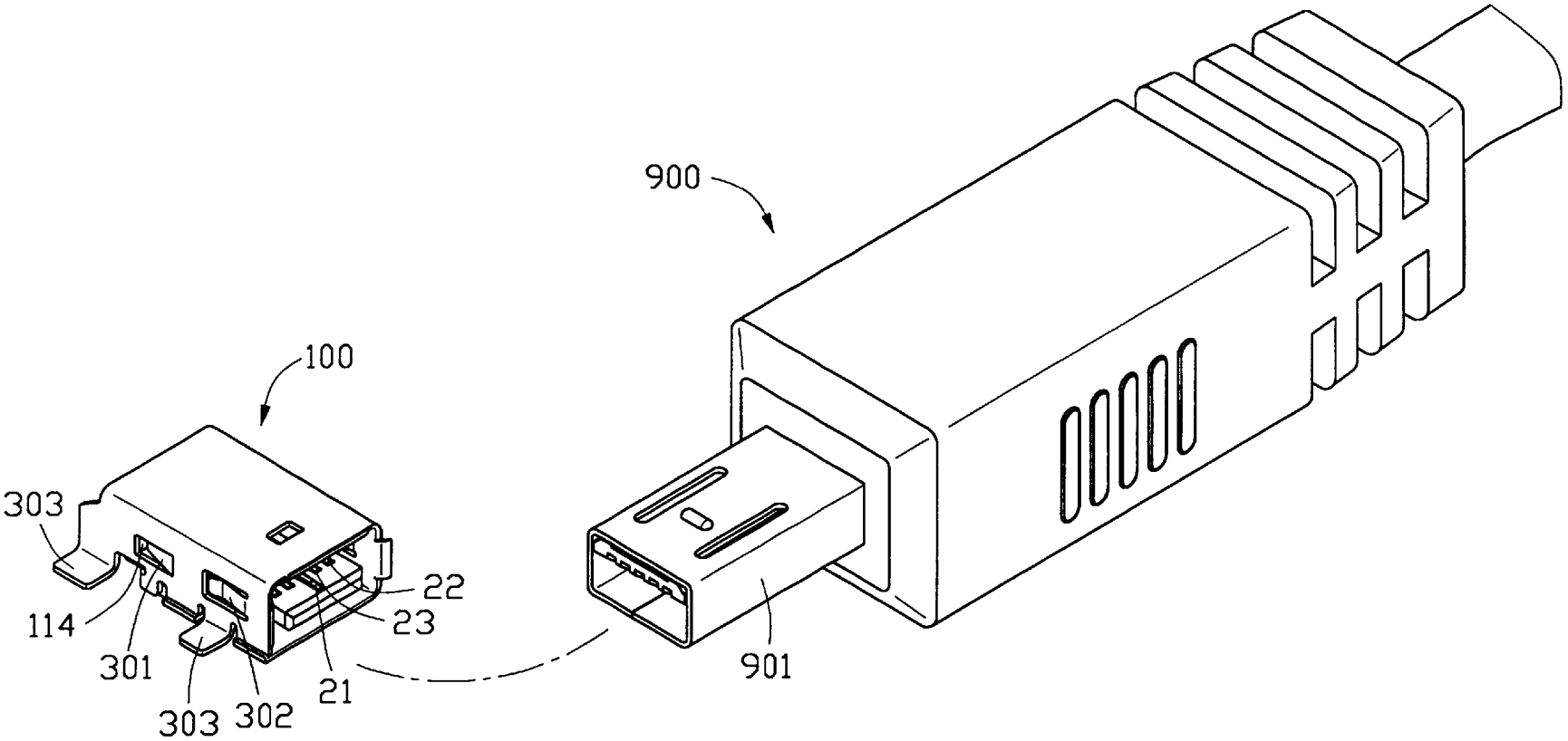
FIG. 3 is a perspective view showing the universal serial bus connector of the present invention to be mated with a mating connector.

Also referring to FIG. 3, the shield 30 forms a pair of inward projections 301 fitted into side slots 114 defined in opposite sides of the base 11 thereby securing the shield 30 to the housing 10. The shield 30 also forms inward grounding tabs 302 in front of the projections 301 for engaging with a shield 901 of a mating USB cable connector 900, and solder pads 303 for soldering to the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing having at least three receiving passageways arranged in one row with a middle receiving passageway being longer than other two side receiving passageways;

at least three terminals comprising a grounding terminal and two signal terminals being correspondingly received in the receiving passageways, wherein the grounding terminal has a length longer than the two signal terminals and is received in the middle receiving passageway, and the signal terminals are received in the two side receiving passageways; and a metal shield enclosing the insulative housing and having a pair of inward projections;

wherein the housing forms at least three protrusions projecting into the receiving passageways and mating with recesses defined in a front edge of each terminal for securing a front end portion of the terminals to the housing; wherein the insulative housing has a base and a mating tongue projecting from the base having the receiving passageways defined in a face thereof; wherein the base of the insulative housing comprises a side slot for receiving said inward projections and a plurality of through holes communicating with the receiving passageways, respectively; wherein each terminal has a retaining portion received in a corresponding through hole and the retaining portion forms barbs biting into the housing; wherein each terminal has a soldering portion integral with retaining portion and extending out of the corresponding hole for soldering to a printed circuit board.

2. An electrical connector comprising:

an insulative housing having a base and a mating tongue extending forwardly from a front face of the base, the mating tongue defining a plurality of receiving passageways arranged in a row in a face thereof with a middle receiving passageway and side receiving passageways beside the middle receiving passageway; and a plurality of terminals received in the housing with a grounding terminal received in the middle receiving passageway and signal terminals received in the side receiving passageways, each terminal defining a recess in a front edge thereof fittingly receiving a protrusion projecting rearwardly from the mating tongue into the corresponding receiving passageways to fix a contacting portion of the terminal to the mating tongue; wherein the base of the insulative housing comprises a side slot and a plurality of through holes communicating with the receiving passageways, respectively; wherein each terminal has a retaining portion received in a corresponding through hole and the retaining portion forms barbs biting into the housing; wherein each terminal has a soldering portion integral with retaining portion and extending out of the corresponding hole for soldering to a printed circuit board; wherein the middle receiving passageway is longer than the side receiving passageway and the grounding terminal is longer than the signal terminals.

* * * * *